United States Patent [19]

Itou et al.

[11] 4,023,128

[45] May 10, 1977

[54] TEMPERATURE RESPONSIVE REED SWITCH

[75] Inventors: Tomio Itou; Michio Ishikawa; Tokio Furuse, all of Tokyo, Japan

[73] Assignee: TDK Electric Co., Ltd., Tokyo, Japan

[22] Filed: Feb. 20, 1976

[21] Appl. No.: 659,937

[30] Foreign Application Priority Data

Oct. 23, 1975 Japan ..... 50-144983[U]

[52] U.S. Cl. ..... 335/208; 335/217

[51] Int. Cl.² ..... H01H 37/32

[58] Field of Search ..... 335/208, 217

[56] References Cited

UNITED STATES PATENTS

| | | | |
|---|---|---|---|
| 3,008,019 | 11/1961 | Scheidig | 335/208 |
| 3,750,064 | 7/1973 | Kato et al. | 335/208 |
| 3,812,441 | 5/1974 | Sakamoto et al. | 335/208 |
| 3,895,328 | 7/1975 | Kato et al. | 335/208 |
| 3,903,492 | 9/1975 | Endo et al. | 335/208 |

*Primary Examiner*—George Harris

*Attorney, Agent, or Firm*—Oblon, Fisher, Spivak, McClelland & Maier

[57] ABSTRACT

A temperature responsive reed switch having magnetic reed pieces, a permanent magnet disposed near a contact of the reed switch and being magnetized in an axial direction of the reed switch, two temperature responsive magnetic materials disposed adjacent the ends of the permanent magnet in the axial direction of the reed switch and a magnetic yoke disposed adjacent the outer surfaces of the temperature responsive magnetic material.

6 Claims, 9 Drawing Figures

(a)

(b)

TEMPERATURE RESPONSIVE REED SWITCH

BACKGROUND OF THE INVENTION

1. Field of the Invention

The present invention relates generally to a temperature responsive reed switch, and more particularly to a make-type temperature responsive reed switch wherein a contact is in an ON state at higher than a Curie point and is in an OFF state at lower than the Curie point.

2. Description of the Prior Art

Various temperature responsive reed switches have been proposed and used as temperature control switches, such as, for example, those disclosed in U.S. Pat. No. 3,750,064 to Kato et al. and in U.S. Pat. No. 3,812,441 to Sakamoto et al.

In these known switches, a reed switch, a permanent magnet and a temperature responsive magnetic material are connected in a manner that temperature response of the switch is not satisfactory and an inferior heat absorbing and radiating effect of the temperature responsive magnetic material is provided. These switches also suffer from the disadvantage of being difficult to attain the ON-OFF operation with high accuracy at the part being affected by the outer magnetic field, because the operation temperature is varied by the effect of the outer magnetic field.

SUMMARY OF THE INVENTION

It is therefore an object of the present invention to provide a temperature responsive reed switch which overcomes the foregoing disadvantages of inferior temperature response and low accuracy ON-OFF operation belonging to the previously known temperature responsive reed switches.

The foregoing object, and others as well, of the present invention are attained by providing a temperature responsive reed switch which comprises a reed switch having magnetic reed pieces, a permanent magnet being disposed near a contact of the reed switch and being magnetized in an axial direction of the reed switch, two temperature responsive magnetic materials disposed adjacent to both ends of the permanent magnet in the axial direction of the reed switch and a magnetic yoke disposed adjacent to the outer surfaces of the two temperature responsive magnetic materials.

BRIEF DESCRIPTION OF THE DRAWINGS

Other objects, features and attendant advantages of the present invention will be more fully appreciated as the same becomes better understood from the following detailed description when considered in connection with the accompanying drawings in which like reference numerals designate like or corresponding parts, and wherein.

DETAILED DESCRIPTION OF THE PREFERRED EMBODIMENTS

Figure 1:
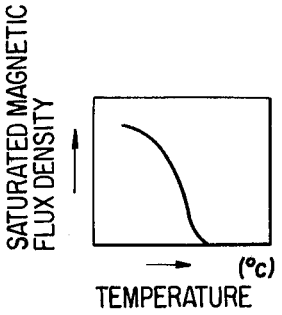
FIG. 1 is a graph showing the relation of saturated magnetic flux density versus temperature of temperature responsive magnetic substances.

Referring now to the drawings, and more particularly to FIG. 1, which, as indicated, is a graph showing the relation of saturated magnetic flux density versus temperature of a temperature responsive magnetic substance, it is seen that in the temperature responsive magnetic material, such as a temperature responsive ferrite, the saturated magnetic flux density is decreased depending upon an increase of temperature, and the magnetic property is lost to be paramagnetism when the temperature reaches the Curie point.

Figure 2:
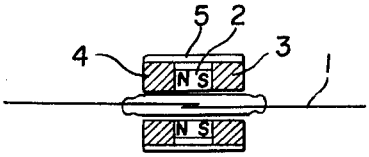
FIG. 2 is a sectional side view of one embodiment of a switch according to the present invention.

The purpose of this invention is to attain accurate turn-on and turn-off of the contact of the reed switch by utilizing the characteristics of a temperature responsive magnetic material. One embodiment of a switch achieving such accuracy in operation is illustrated in FIG. 2, wherein a known reed switch 1 is shown having a permanent magnet 2 disposed near the outer part of the contact of the reed switch, such permanent magnet 2 being magnetized to provide an S pole at one end and an N pole at the other end along the axial direction of the reed switch. Each of the temperature responsive magnetic materials 3 and 4 is made of temperature responsive ferrite and is contacted with each of the end surfaces of the S pole and the N pole in a fixed condition. The outer surfaces of the permanent magnet 2 and the temperature responsive magnetic materials 3 and 4 are covered with a magnetic yoke 5 formed in one piece.

Figure 3:
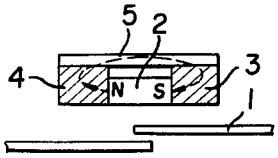
FIG. 3 is a partially enlarged view showing the OFF state of contact of the switch in FIG. 2.
Figure 3:
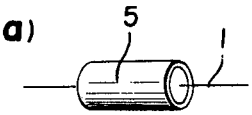

Accordingly, as shown in the enlargement of FIG. 3, when the temperature is lower than the Curie point and the temperature responsive magnetic materials 3 and 4 have enough magnetic property in the switch, the main magnetic flux generated from the N pole of the permanent magnet 2 is passed through the temperature responsive magnetic material 4, the magnetic yoke 5 and the temperature responsive magnetic material 3 to the S pole of the permanent magnet 2. The magnetic flux of the permanent magnet 2 is scarcely passed through the contact of the reed switch 1 in the axial direction, whereby the reed switch 1 keeps its OFF state.

Figure 4:
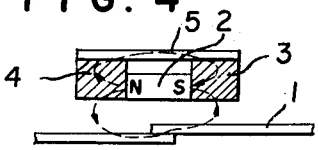
FIG. 4 is a partially enlarged view showing the ON state of contact of the switch shown in FIG. 2.

When the temperature is higher than the Curie point and the magnetic property of the temperature responsive magnetic materials 3 and 4 is lost, as shown in the enlargement of FIG. 4, the magnetic flux is shunt to pass from the permanent magnet 2 through the magnetic yoke 5 to the S pole of the magnet and also to pass through the contact of the reed switch 1 in the axial direction. The contact of the reed switch 1 is thus turned ON by the magnetic flux passing the reed switch 1 in the axial direction.

Figure 5:
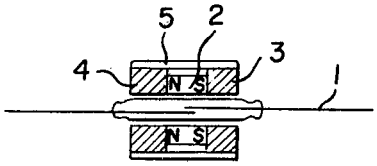
FIGS. 5 and 6 are sectional side views of other embodiments of the switch according to the present invention.
Figure 6:
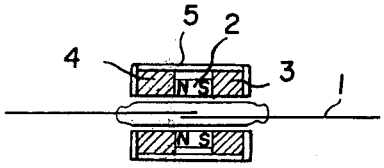

In FIGS. 5 and 6, other embodiments of the switch of the invention are shown, including differing configurations of the magnetic yoke utilized therewith, it being noted that yoke 5 is in contact with magnet 2 in the embodiment of FIG. 5 but the principle of the operation thereof is the same as with that of the embodiment of FIG. 2.

Figure 7:
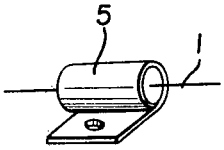
FIGS. 7(a) and (b) are, respectively, schematic views of the other modified magnetic yokes.

As shown in FIG. 7, the shape of the magnetic yoke 5 is modified. The method and manner of assembly can be desirably selected by modifying the shape of the magnetic yoke depending upon the uses.

In accordance with the present invention, the permanent magnet, the temperature responsive magnetic materials and the magnetic yoke are assembled in a specific arrangement. The magnetic yoke, which protects the mechanically brittle temperature responsive magnetic material and the permanent magnet, can be used as a magnetic shield and also used for heat absorption and radiation of the temperature responsive magnetic material. Accordingly, even though the temperature responsive reed switch of the invention is kept within a magnetic material near to the place being affected by the outer magnetic field, the temperature responsive reed switch shows no variation of the characteristics of the operation temperature.

Obviously, many modifications and variations of the present invention are possible in light of the above teachings. It is therefore to be understood that within the scope of the appended claims, the present invention may be practiced otherwise than as specifically described herein.

What is claimed as new and desired to be secured by Letters Patent of the United States is:

1. A temperature responsive reed switch comprising:

a reed switch having magnetic reed pieces;

a permanent magnet disposed near the contact of said reed switch and being magnetized in the axial direction of said reed switch;

temperature responsive magnetic materials disposed upon opposite sides of said permanent magnet in the axial direction of said reed switch; and magnetic yoke means disposed about the outer surface of said temperature responsive magnetic materials and said permanent magnet for physically and magnetically protecting said materials and said magnet, and in contact with the said materials for absorbing and radiating heat from and to said materials.

2. The temperature responsive reed switch according to claim 1 wherein two temperature responsive magnetic materials are disposed adjacent to both ends of said permanent magnet in the axial direction of the reed switch.

3. The temperature responsive reed switch according to claim 1, wherein said temperature responsive magnetic material has magnetic property when the temperature is lower than the Curie point and has no magnetic property when the temperature is higher than the Curie point.

4. The temperature responsive reed switch according to claim 1, wherein said magnetic yoke is in contact with said permanent magnet.

5. The temperature responsive reed switch according to claim 1, wherein said magnetic yoke completely covers the outer surfaces of said temperature responsive magnetic material, including the axial and the radial outer surfaces thereof.

6. The temperature responsive reed switch according to claim 1, wherein said magnetic yoke is separated from said permanent magnet.

* * * * *